United States Patent [19]

Bennett et al.

[11] 3,951,506

[45] Apr. 20, 1976

[54] FAIL-SAFE CONNECTOR

[75] Inventors: Frederick L. Bennett, Granada Hills; Robert M. Bridges, Northridge; Harold A. Gray, Burbank, all of Calif.

[73] Assignee: The Bendix Corporation, North Hollywood, Calif.

[22] Filed: Apr. 24, 1975

[21] Appl. No.: 571,146

[52] U.S. Cl. ..... 339/104; 339/102 R; 339/103 M

[51] Int. Cl.[2] ..... H01R 13/58

[58] Field of Search ..... 339/104, 102 R, 103 R, 339/103 C, 103 M, 148, 150 R, 46

[56] References Cited

UNITED STATES PATENTS

| | | | |
|---|---|---|---|
| 3,280,246 | 10/1966 | Lawson et al. | 339/103 M X |
| 3,439,112 | 4/1969 | Brown et al. | 339/104 X |

*Primary Examiner*—Roy Lake
*Assistant Examiner*—DeWalden W. Jones
*Attorney, Agent, or Firm*—Robert C. Smith; William F. Thornton

[57] ABSTRACT

To avoid possible damage to an associated hoist and sheaves, a cable termination is provided which has the capability of permitting a cable to be separated cleanly from a firmly anchored connector at the hoist when the cable is subjected to a limited force. To insure that resistance of the cable to being separated from the connector is limited, the individual conductors are trimmed to varying lengths before being soldered or fastened to the connector. The wires and connections are then potted with a first potting material which has limited shear strength, and this assembly then has a jacket of high strength insulating material molded to its outside covering part of the connector, the first potting material, and a portion of the cable jacket, thereby forming a good watertight seal at the connector and around the cable. When subjected to a predictable axial force, the annular seal fails and the conductor leads are each (or in small groups) subjected to the entire applied axial force in turn, thus causing the conducting wires to fail in sequence rather than permitting several wires to carry the load at once. With the successive failures of the connectors, the low strength interior potting compound crumbles and the conducting wires pull free of the connector without carrying any hard potting material or other connector parts which would cause the separated part to have a diameter significantly greater than the cable itself.

7 Claims, 8 Drawing Figures

FAIL-SAFE CONNECTOR

BACKGROUND OF THE INVENTION

Applicants have, for a number of years, been associated with production of an airborne sonar system in which a sonar transducer of substantial weight is carried in a helicopter and periodically lowered into and raised from the water at the end of a cable by means of a hoist mechanism driving the cable. The cable used typically has a substantial number of individual conducting wires (or small bundles of wires) as well as a wire rope strength member carried at its center. The hoist mechanism is driven in such manner as to cause the transducer to be lowered into the water or returned to the helicopter, thereby coiling the cable onto its reel. The inner end of the cable is terminated at an electrical connector which is fixedly secured to the reel. In a preferred arrangement the cable passes through an opening in the cylindrical spool surface of the reel, and the connector is fastened to a support on the interior of the said spool surface. As the cable leaves the reel it is caused to pass over a pair of sheaves and past a cable angle sensor which makes contact with the cable and which is attached to the hoist mechanism such that it provides a signal indicating the angle of descent of the cable relative to the attitude of the helicopter.

For various reasons the cable may separate from the reel. It may happen because of a malfunction in the operation of the hoist mechanism or because of errors in judgement of the hoist operator. It may happen intentionally because of operating difficulties with the helicopter or because of threatened imminent hostile action whereby the helicopter pilot needs to jettison the cable and transducer quickly. For whatever reason separation occurs, it should occur at a limited and predictable force, and when it occurs the cable should pull clean from the connector so that there is not a substantial ball or chunk of potting compound or other material of significantly greater diameter than the cable adhering to the cable to be pulled through or past the sheaves and the cable angle sensor. Such a larger diameter protuberance can cause substantial damage to the hoist mechanism including the sheaves as well as to the cable angle sensor. (There is also a possibility that such a protuberance could become lodged or wedged in the hoist mechanism, leaving the length of cable and the transducer still connected to the helicopter.) It therefore becomes of great importance that the connection of the cable to the connector at the reel be such that the cable will always pull away clean from the connector.

DESCRIPTION OF THE PREFERRED EMBODIMENT

Figure 1A:
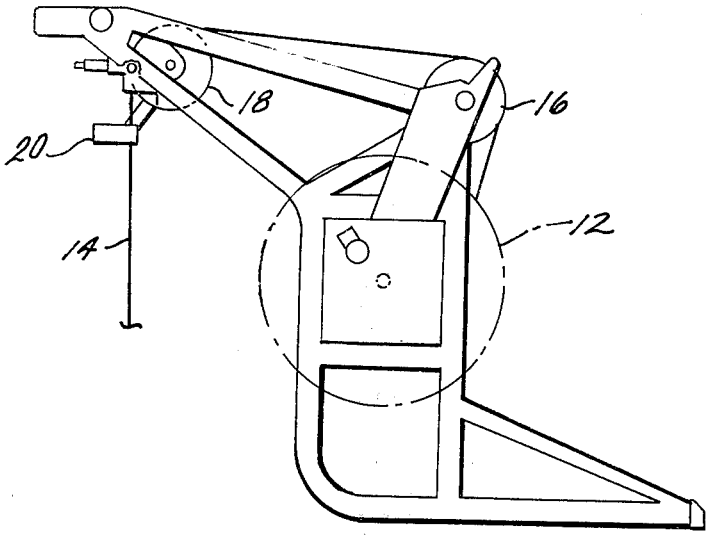
FIG. 1A is a plan view of the hoist mechanism with which our cable termination is used.
Figure 1B:
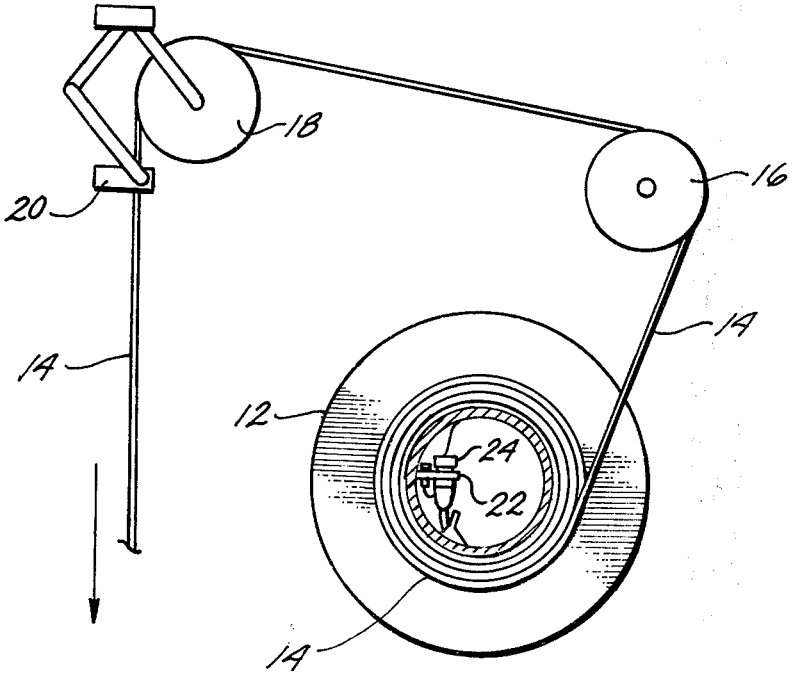
FIG. 1B is an enlarged view, partly in section, showing details of the cable drum of FIG. 1.

FIG. 1 is a plan view of the hoist mechanism with which our cable is used. The hoist consists of a frame 10 carrying a reel 12 upon which the cable is normally carried. Layers of cable 14 on the reel extend upwardly over a level wind sheave 16 and a tow sheave 18 from which the cable and a transducer (not shown) are suspended. A cable angle sensor 20 is attached to the frame 10 near the tow sheave 18 in such a way that it is moved with the cable as the angle of descent of the cable changes. Attached to the center of reel 12, as shown in FIG. 1B is a flange 22 which supports and retains the electrical connector 24. It is intended that when the cable 14 is entirely unwound from the drum 12, only a limited amount of force will be required to separate cable 14 from the connector 24.

Figure 2:
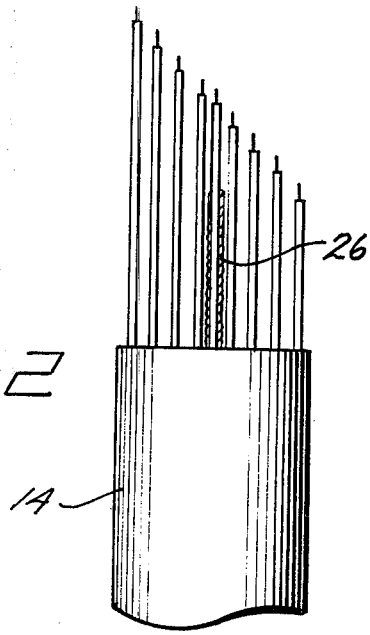
FIG. 2 is a plan view of the cable with conductors trimmed to the desired lengths before being fastened to the connector.

The manner in which a connection of limited strength is implemented is described in the following figures. FIG. 2 shows the inside or "dry" end of the cable 14 with the insulating jacket cut back and the individual conductors trimmed to varying lengths prior to being fastened to the connector 24. It will be observed that in addition to the individual electrical conductors shown in cable 14 there is also a wire rope center strength member 26 which is trimmed short of the shortest conducting wires. This member 26 includes one or more very light wires which are also fastened to the connector and which may serve as ground leads. These wires are also of a length different from the other conducting wires. While individual conductors are shown, each may also be a small bundle of wires. If such a bundle is used, the individual wires may be of the same length if their combined strength is not in excess of the force at which it is desired to separate the cable from the connector; otherwise, these also should be of varying lengths.

Figure 3:
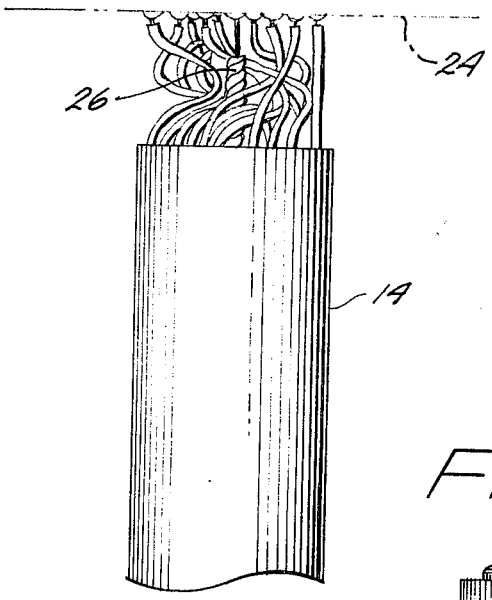
FIG. 3 is a plan view showing the conductors as fastened to the connector.

FIG. 3 shows the cable 14 after all of the conducting members and the light wires of the center strength member 26 are soldered to the connecting member of the connector 24. These members may be of other types but are preferably typical small female soldering cups. It will be observed that the conductors are connected so that one lead or group of leads is essentially taut, the next has a small amount of slack, a third somewhat greater amount of slack, a fourth lead even more slack, etc., until the entire group of conducting wires is connected. Obviously the conductors which were trimmed to the greatest length have the greatest amount of slack as connected to the soldering lugs.

Figure 4:
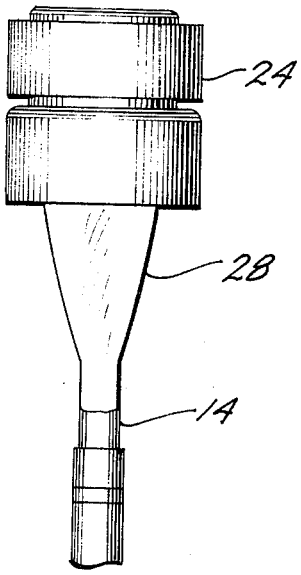
FIG. 4 is a plan view of the cable with the conductors fastened to the connector and enclosed in a first molded potting material.

In FIG. 4 the cable 14 is shown connected to the connector 24 as described with respect to FIG. 3, but all the wire leads have been encapsulated in a potting compound consisting of a soft urethane material 28 which serves to maintain the relative position of the leads.

Figure 5:
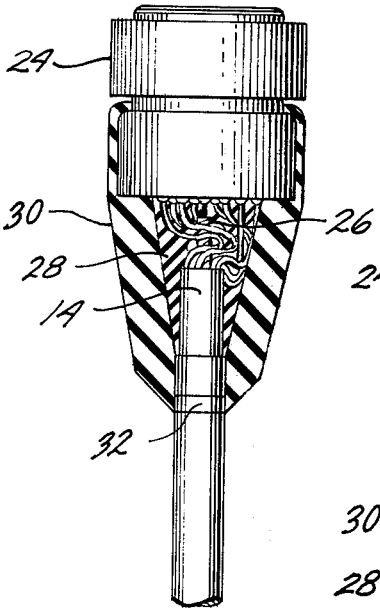
FIG. 5 is a plan view, partly in section, of the completed connection with a second insulating and protecting layer molded around the first molded material, the cable and part of the connector.

FIG. 5 is a plan view, partly in section, showing the connector assembly as in FIG. 4 but with an additional layer of protective and insulating potting material 30 molded around the cable 14, the first potting layer 28, and a portion of the connector 24. The final potting layer 30 is molded around the assembly using a high strength urethane such that it surrounds and seals against the end of the connector 24 and also bonds to an annular area of the cable 14 as shown at numeral 32. This layer 30 provides an adequate moisture barrier to seal the potting layer 30 to the connector 24 and the insulating jacket of cable 14, but the bond 32 is of limited shear strength as will appear hereafter.

Figure 6:
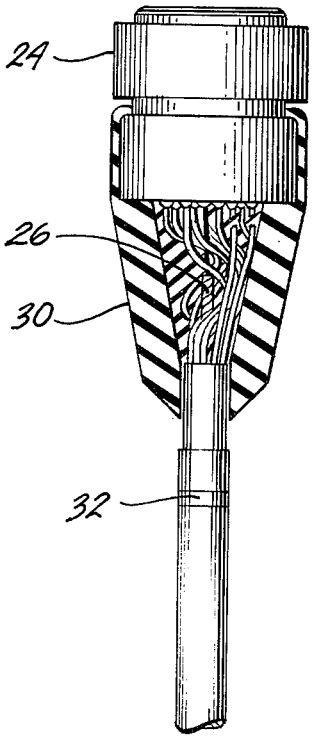
FIG. 6 is a sectional view showing an early stage of separation of the conductors from the connector.
Figure 7:
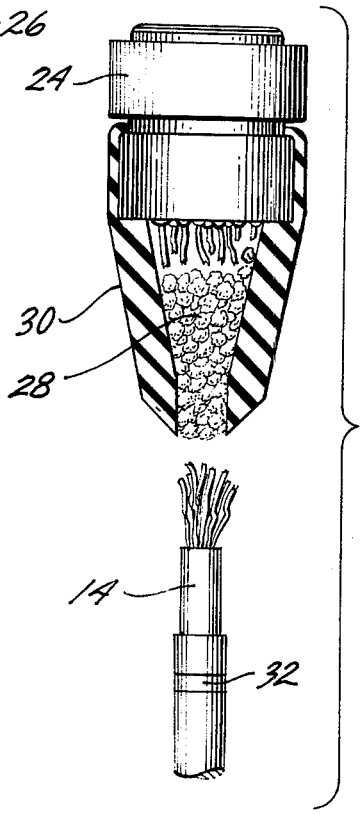
FIG. 7 is a sectional view showing the final stage of separation of the cable from the connector.

FIG. 6 is a sectional view of the cable end and connector showing the cable being subjected to a force sufficient to cause a failure between the cable 14 and the connector 24. It will be observed that the adhesive bond 32 has failed and has pulled away from the potting layer 30. The shortest two of the conductors have failed and have separated from the connector, and other conductors remain fastened to the connector 24. In FIG. 7 the cable 14 is shown completely pulled away from the connector 24 and also from the crumbled and fragmented interior potting layer 28. Since the conductors fail progressively as each is pulled taut from the failure of the one before, it will be recognized that the force required to separate cable 14 from conductor 24 should not exceed, significantly, that required to separate any single conductor. The end of cable 14 is free of any chunks of potting material or any other material which could damage the sheaves or the cable angle sensor of the hoist mechanism, and the cable will pull through the hoist without wedging or interference of any kind.

Obviously this invention is applicable to connectors and cables of many configurations and numbers and types of leads. While individual wires are shown herein, some or all could as well be bundles of wires or stranded wires. And while certain specific potting materials have been described herein, those skilled in the art will recognize that others may do as well.

We claim:

1. In a cable termination comprising an electrical connector having terminals for a large number of wires, a cable including a large number of electrical conducting wires connected to said terminals, and an insulating jacket surrounding said wires, characterized in that said electrical conducting wires are of graduated lengths such that the shortest of said conducting wires is connected essentially taut to said connector and others of said wires have varying amounts of slack such that no more than a limited number of said wires are of substantially equal length, a soft flexible material having a low shear strength encapsulating said wires, and a covering sheath of high strength flexible material, such that when said cable is subjected to a high force tending to separate said cable from said connector, said force is applied to said shortest wire and then to the wires of successively greater length as the shorter wires fail until the cable is entirely separated from said connector.

2. A cable termination as set forth in claim 1 wherein said cable includes a high strength wire rope member, said member is trimmed short of the shortest of said electrical conducting wires and a light conducting wire is connected from said wire rope member to one of said terminals, said wire being of a length different from that of any of said electrical conducting wires.

3. A cable termination as set forth in claim 1 wherein said soft flexible material crumbles as said conducting wires fail.

4. A cable termination as set forth in claim 1 wherein said covering sheath is bonded to said insulating jacket over a limited annular area and to said connector to provide watertight seals at each bond.

5. A cable termination as set forth in claim 4 wherein said force is applied to said cable, said annular seal fails initially before any of said wires fail.

6. A method of connecting a multiconductor electrical cable having an external insulating jacket to a connector having connecting lugs to insure that said cable will separate cleanly from said connector with the application of a limited force to said cable comprising the steps of:

a. trimming the individual conductors of said cable to varying lengths, b. fastening said conductors to said connecting lugs so that one such conductor is taut and others of said conductors have varying amounts of slack, c. encapsulating said conductors and said connecting lugs in a soft, flexible material having low shear strength, d. molding a covering sheath of high strength flexible material to said connector, said encapsulating material and said insulating jacket, and bonding said sheath to said insulating jacket over a limited annular area.

7. A method of connecting a multiconductor electrical cable as set forth in claim 6 wherein said cable includes a wire rope strength member, said strength member is trimmed slightly shorter than the length of the shortest of said conductors, and a lightweight conductor is connected between said strength member and one of said lugs.

* * * * *